United States Patent [19]

Glorioso et al.

[11] 3,953,276

[45] Apr. 27, 1976

[54] ETCHING APPARATUS WITH PLURAL NOZZLE ARRANGEMENTS

[75] Inventors: Edward J. Glorioso, Downers Grove; Martin L. Lerner, River Forest, both of Ill.

[73] Assignee: Zenith Radio Corporation, Chicago, Ill.

[22] Filed: Apr. 19, 1974

[21] Appl. No.: 462,277

Related U.S. Application Data

[63] Continuation of Ser. No. 301,033, Oct. 26, 1972, abandoned.

[52] U.S. Cl. ..... 156/345; 156/8; 156/18

[51] Int. Cl.[2] ..... C23F 1/02

[58] Field of Search ..... 156/7, 8, 12, 15, 18, 156/345; 134/176, 179, 180, 181; 239/556, 560, 557, 565, 549

[56] References Cited

UNITED STATES PATENTS

| | | | |
|---|---|---|---|
| 1,559,727 | 11/1925 | Merseles et al. | 134/176 |
| 2,648,931 | 3/1972 | Jacobs | 239/248 |
| 2,808,842 | 10/1957 | Pollock et al. | 134/101 |
| 2,918,927 | 12/1959 | Clearman | 134/176 |
| 3,285,779 | 11/1966 | Dunham | 134/176 |
| 3,370,869 | 2/1968 | Dutcher | 285/110 |
| 3,666,579 | 5/1972 | Dietch | 156/16 |
| 3,702,277 | 11/1972 | Lerner | 156/345 |
| 3,702,277 | 11/1972 | Lerner | 156/345 |

*Primary Examiner*—William A. Powell
*Assistant Examiner*—Brian J. Leitter

[57] ABSTRACT

An apparatus for re-etching the apertures of different size shadow masks has a plurality of sets of etchant supply arms individually having an effective length related to a particular mask size, each set being connected to an assigned one of a corresponding plurality of etchant supply means. Each of the supply means is individually selected by a selecting means for connection to a source of etchant material suitable for attacking the masks.

9 Claims, 4 Drawing Figures

FIG. 1
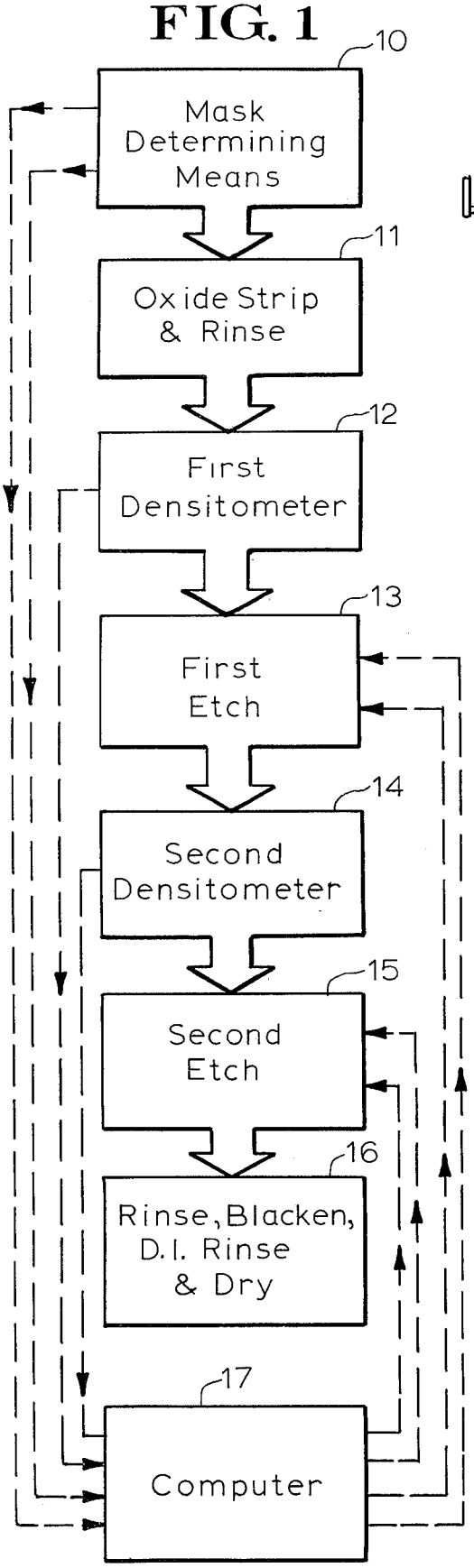
FIG. 2
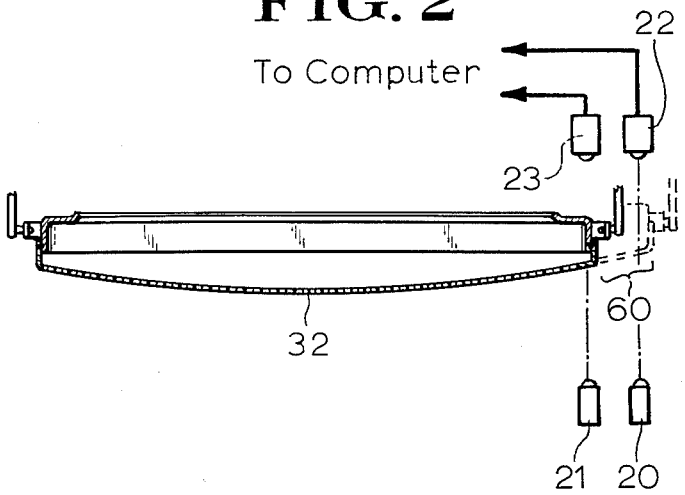
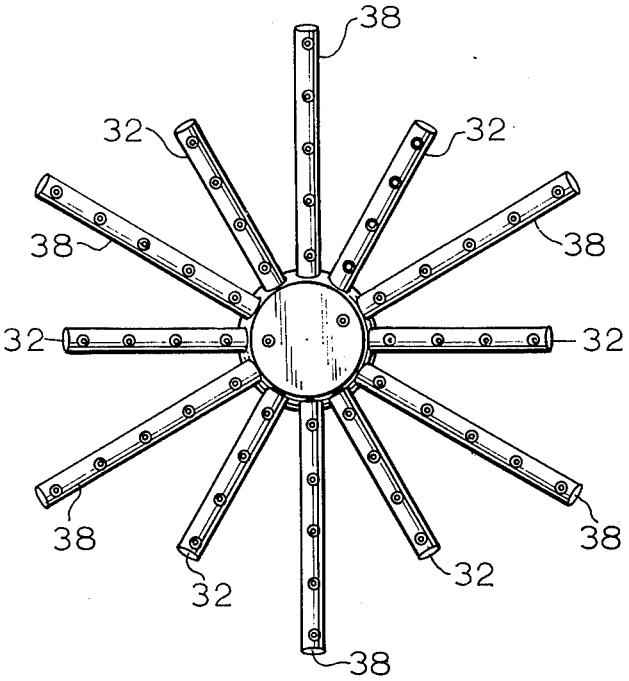
FIG. 4

ETCHING APPARATUS WITH PLURAL NOZZLE ARRANGEMENTS

This is a continuation of application Ser. No. 301,033, filed Oct. 26, 1972 now abandoned.

BACKGROUND OF THE INVENTION

The present invention is concerned with an improved apparatus for re-etching the shadow mask of a color cathode-ray tube.

Re-etching is a technique that has been adopted in the manufacture of color picture tubes featuring black-surround screens of the type described and claimed in U.S. Pat. No. 3,146,368 issued Aug. 24, 1964 in the name of Joseph P. Fiore and Sam H. Kaplan. Such a screen in its preferred form is a mosaic structure comprised of a multiplicity of phosphor dot triads disposed in an ordered array throughout the image or screen area. Each such triad includes a dot of green phosphor, a dot of blue and a dot of red phosphor. The screen differs from the conventional mosaic color screens by having phosphor dots reduced in dimension so that, instead of being in tangential contact with one another, they are separated from one another. Another particularly important and distinguishing feature is that the spaces which surround the phosphor dots are covered with a light-absorbing material, such as graphite. In short, each phosphor dot has a circumscribing ring of dark, light-absorbing material from which the screen derives its name "black-surround."

It is common practice in screening such a tube to locate and dimension deposits of the various phosphor materials by photographic printing in which a photosensitive material is exposed to actinic energy directed from a source to the screen through the apertures of a shadow mask assigned to that screen and positioned in operating relation thereto during the exposure step. In order to have phosphor dots of reduced size, while retaining the efficiency and tolerance characteristic of conventional triad color tubes, it is distinctly preferred that the electron beams of the tube be larger in diameter than the phosphor dots. This obviously presents problems in screening, namely, the problem of establishing desired relative dimensions of phosphor dots to excitation electron beams.

A most successful process of screening, achieving the desired relative dimensions, features the use of a shadow mask having a pattern of apertures initially dimensioned as required to screen the phosphor materials on the tube faceplate. After screening has been accomplished through well known photographic techniques, the mask is subjected to further etching to enlarge the apertures to a precisely controlled size in order that the electron beams, which obviously are dimensioned by the apertures of the mask through which the beams reach the screen, have an accurately determined diameter, larger than the phosphor dots. This general process is referred to as "etch-back" or "re-etch". A control system for precisely dimensioning the mask apertures in the re-etch process is fully described in U.S. Pat. No. 3,669,771, issued on June 13, 1972, in the name of Martin Lerner, and is assigned to the assignee of the present invention.

Re-etch apparatuses of the prior art have had the distinct disadvantage of only being able to properly etch a single size shadow mask. In a cathode-ray tube manufacturing facility where more than one size tube is produced this disadvantage causes many problems. In the usual case, such manufacturing facilities employ a conveyer system where each tube is processed seriatim. As a consequence, if re-etching is to be compatible with such a system a number of re-etch lines corresponding in number to the number of different tube sizes must be provided. Unfortunately, this involves extremely excessive capital investment which makes such employment prohibitive. The only alternative is to have one re-etch line which comprises re-etch apparatuses which may be converted over from time to time to suit different mask sizes. This however has the disadvantage of requiring stock piling of the shadow masks of each size, and storing the corresponding image screen panels. Such a procedure is expensive and disruptive to the normal flow of the overall manufacturing process. Also, as a consequence of stock piling, since a defect in the process for a particular tube size may not be detected until final test, a rather large number of defective tubes or panels may be manufactured before the defect is detected.

It is therefore an object of the present invention to provide an improved re-etch apparatus which avoids the disadvantages of prior art apparatuses.

It is another and particular object of the invention to provide a re-etch apparatus which is capable of re-etching shadow masks of different sizes.

SUMMARY OF THE INVENTION

An apparatus for re-etching the apertures of different size shadow masks to be used in color cathode-ray tubes having faceplate panel sections of corresponding sizes comprises a source of etchant material suitable for attacking such shadow masks, a plurality of etchant supply means, and a corresponding plurality of sets of etchant supply arms individually having an effective length related to a particular mask size. The apparatus also comprises means for connecting each of the supply means individually to an assigned one of the sets of etchant supply arms and selector means for connecting one of the supply means to the source of etchant material.

BRIEF DESCRIPTION OF THE DRAWINGS

The features of the present invention which are believed to be novel are set forth with particularity in the appended claims. The invention, together with further objects and advantages thereof, may best be understood by reference to the following description in connection with the accompanying drawing, in the several figures of which like reference numerals indicate identical elements and in which:

FIG. 1 is a block diagram representation of a re-etch system which embodies the present invention;

FIG. 2 is a side view of a shadow mask and re-etch control apparatus illustrating a particular aspect of the present invention;

FIG. 4 is a view of two different sets of radially extending etchant supply arms which may be used for practicing the present invention.

DESCRIPTION OF THE PREFERRED EMBODIMENT

Figure 3:
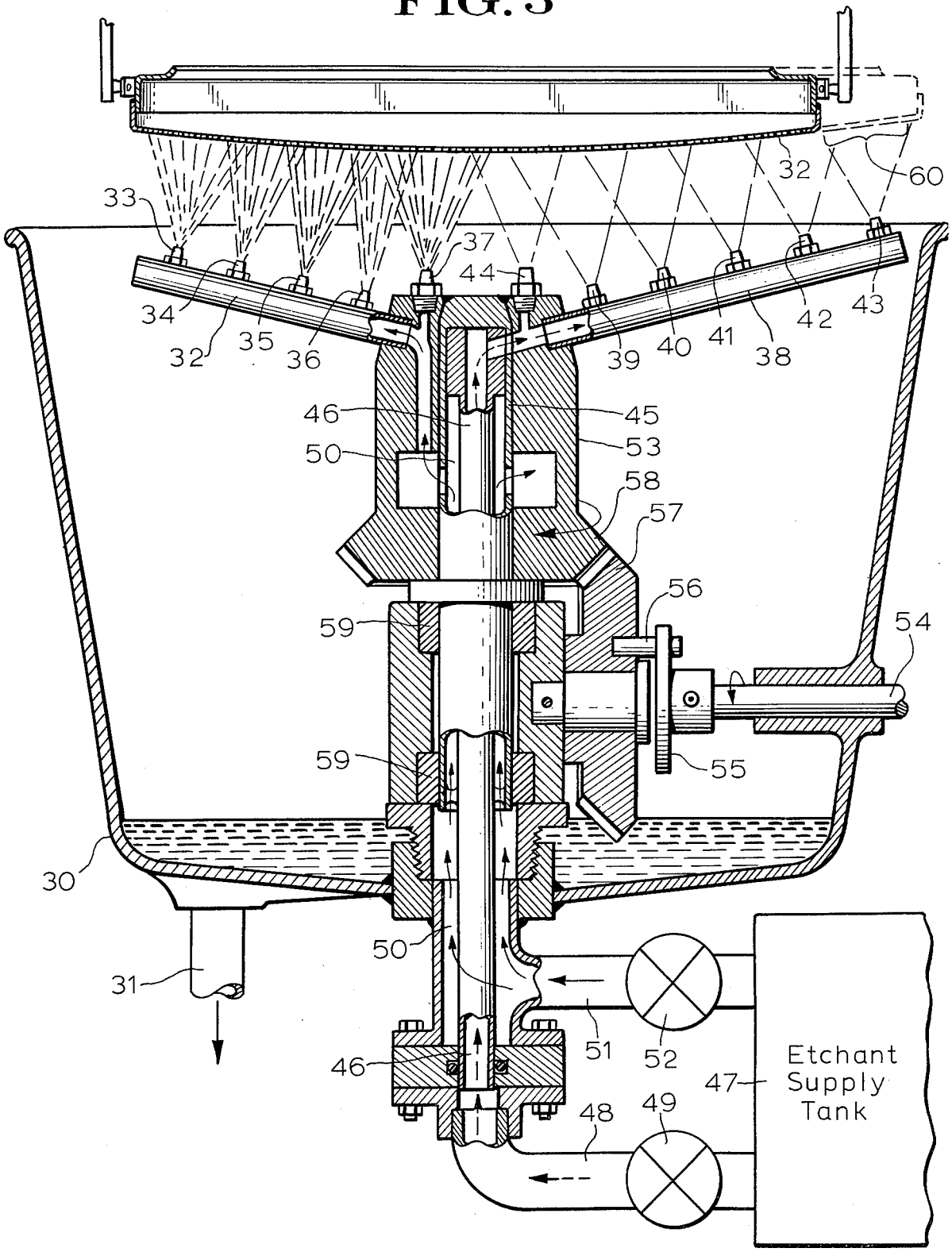
FIG. 3 is a side view, partially in cross section and partially cut away showing a re-etch apparatus embodying the present invention.

Referring now to the drawings, the system of FIG. 1 shown in block diagram form is for re-etching the apertures of shadow masks to a finely controlled degree. The system is arranged for mask production in which a conveyor presents a succession of shadow masks seriatim to the various processing stages of the system. While the present invention may be practiced for re-etching the apertures of shadow masks of any number of different sizes, for purposes of simplicity, the preferred embodiment herein described shall be limited to re-etching of two different size shadow masks. The first stage to which the conveyer presents a mask is mask size determining means stage 10 wherein the size of the shadow mask is determined. The mask size information developed by stage 10 is stored in computer 17 for future reference. After the size of the mask has been determined the mask is then conveyed to oxide strip and rinse stage 11. Prior to the image screen exposure process it is common practice to blacken the mask or provide it with an oxide coating so that its radiation properties are analogous to those of a black body. The oxide, however, resists the attack of an etchant otherwise effective in enlarging the apertures of the mask in process. The mask usually is formed of cold rolled steel and a suitable etchant is ferric chloride. In order to avoid attenuating the effect of the etchant, the mask is treated at work station 11 with hydrochloric acid and an inhibitor which strip the oxide coating after which the mask is rinsed with water and conveyed to the following stations.

At first densitometer stage 12, the initial aperture size of the shadow mask is determined. The details of the components which may be used to effectively determine the initial aperture size of the mask are fully described in the aforementioned Lerner patent. The information as to the initial size of the apertures of the shadow mask is stored in computer 17, along with the mask size information, for future reference. The shadow mask, is then ready for a first etch which is accomplished in first etch stage 13. First etch stage 13 includes a re-etch apparatus embodying the present invention which is capable of re-etching the apertures of either size shadow mask. This apparatus will be described in more detail later. Computer 17 provides an appropriate signal to etch stage 13 to selectively energize the etching apparatus to accommodate the particular mask size. After the mask has been initially etched in stage 13, it is then conveyed to second densitometer stage 14 where the size of the apertures of the mask is once again determined. This information is also stored in computer 17, which among other things, determines the etch rate of that particular mask taking into account the different etching parameters such as the chemical composition of the etchant, spray pressure, and the amount of enlargement of the apertures since the initial densitometer reading at stage 12.

The mask, having been etched for the first time and had its etch rate determined is then conveyed to second etch stage 15 which also comprises a re-etch apparatus of the type incorporated into first etch stage 13. Computer 17 provides an appropriate signal to selectively energize the etching apparatus to accommodate the particular mask size and also to control the length of time that the shadow mask is to be exposed to the etchant in order to render the apertures of the shadow mask a desired final size. After the shadow mask has been re-etched in second etch stage 15 it is conveyed to stage 16 where it is rinsed, blackened, rinsed again with de-ionized water, and dried. A mask formed of cold rolled steel may have a carbon film thereon upon emergence from the re-etch stations; this film is removed by a treatment of phosphoric acid. Blackening is undertaken to restore an oxide coating to the surfaces of the mask because it is desirable that the mask have the heat-conducting and light-reflecting properties of a black body as finally installed in the tube and to retard rusting of the mask in subsequent operation. The blackening may be accomplished by heat treatment in an oxidizing atmosphere or this may be accomplished chemically in a salt bath or iron phosphate. These steps are well known and of themselves constitute no part of the present invention. A mask emerging from stage 16 has apertures of the proper final size and is ready for incorporation into its corresponding image screen panel for final processing of the cathode-ray tube.

It can be understood from the foregoing that the system of FIG. 1 is capable of etching two different size shadow masks without requiring conversion of the re-etch apparatus to accommodate the different size shadow masks or requiring a separate re-etch system for each size mask. Computer 17 keeps track of each mask in the process and selects at each re-etch stage the appropriate apparatus mode corresponding to the particular mask size to be re-etched.

FIG. 2 shows a particular embodiment of a mask size determining means for use in stage 10 of FIG. 1. It comprises a plurality of light sources 20 and 21 and a corresponding plurality of light detecting elements 22 and 23. The light sources and light detecting elements are arranged so that the transmission of light from the sources to the light detecting elements is impeded by a shadow mask disposed therebetween. Mask 32 represented by the solid lines depicting a mask of the smaller size, impedes the light transmission between source 21 and light detecting element 23 while not impeding the light transmission between source 20 and light detecting element 22. Thus, for the smaller size mask, light detecting element 22 provides an appropriate output which is stored in the computer. For the larger mask size as shown in dashed lines, representing an extension of one end of shadow mask 32 forming region 60, region 60 extends entirely between the light transmission path of both light sources and light detecting means. As a consequence, light detecting elements 22 and 23 do not develop an output signal, the absence of which informs the computer that the larger mask size is present. Obviously, if no mask is disposed between the light sources and light detecting elements, both light detecting elements produce an output signal to inform the computer that such a condition exists so that the re-etch stages of the process will not be activated.

A re-etch apparatus, embodying the present invention, and which may be incorporated into first re-etch stage 13 and second re-etch stage 15 of FIG. 1 to re-etch the apertures of two different size shadow masks is shown in FIG. 3. The apparatus is enclosed in a tank 30 the bottom portion of which serves as a catch pan or the like for reclaiming etchant from the shadow mask. A return conduit 31 is attached to the bottom of tank 30. Shadow mask 32 is disposed horizontally within the tank with its convex side pointing downwardly. The apparatus has two sets of etchant supply arms one set for re-etching the smaller masks and the other set for re-etching the larger masks. Etchant supply arm 32 is one of the supply arms from the set which re-etches the smaller size shadow masks. It supports spray nozzles 33, 34, 35 and 36. Also operating with the spray nozzles of etchant supply arm 32 is spray nozzle 37 located near the center of the apparatus. Etchant supply arm 38 is one of the supply arms of the set which re-etches the apertures of the larger size shadow masks and supports spray nozzle 39, 40, 41, 42 and 43. Spray nozzle 44 also located near the center of the apparatus is activated along with the set of spray arms which includes spray arm 38. Spray nozzles 37 and 44 spray the center areas of their corresponding masks.

An etchant supply means comprising a pair of coaxial conduits comprises outer conduit 45 and inner conduit 46. Inner conduit 46 receives etchant from etchant supply tank 47 through pipe 48 when control valve 49 is open. Annulus 50 receives etchant through pipe 51 also connected to etchant supply tank 47 when valve 52 is open. The annulus supplies etchant to the set of etchant supply arms comprising etchant supply arms 32 and to spray nozzle 37 and the center conduit 46 supplies etchant to the set of etchant supply arms comprising etchant supply arm 38 and to spray nozzle 44. Housing 53 which supports the etchant supply arms along with the coaxial conduits rotates so that the entire field of apertures of the shadow mask is re-etched uniformly. Shaft 54 terminates in a disc 55 having a pin 56 which engages a miter gear 57 meshing with a miter gear 58 which is part of housing 53. Thus when shaft 54 is rotated, housing 53 and the spray arm rotate. Bearings 59 hold the coaxial conduits in place to maintain their alignment during rotation.

Mask 32 as represented by the solid lines in FIG. 5 depicts a mask of small size while the dashed line extensions forming end region 60 depicts a large size mask. When the smaller mask is to be re-etched, the etchant supply means comprising the annulus 50 connected to etchant supply arm 32 and spray nozzle 37 is selectively connected to the source of etchant by the opening of valve 52 and the closing of valve 49. For this preferred embodiment, the selection is determined by a computer, but of course the selection could also be done manually. Similarly, when the larger mask is to be re-etched, the center conduit 46 connected to etchant supply arm 38 and spray nozzle 44 is selectively connected to the source of etchant by the opening of valve 49 and the closing of valve 52.

FIG. 4 is a view which shows in detail two sets of etchant supply arms which may be incorporated onto the apparatus of FIG. 3 for practicing the present invention. Etchant supply arms 32 are used for re-etching the smaller size shadow masks and etchant supply arms 38 are used for re-etching the larger size shadow masks. For purposes of this preferred embodiment, each set has 6 supply arms for spraying etchant onto the shadow mask. The supply arms receive etchant from the coaxial conduits located at the center of the supply arms (as shown in FIG. 3) and are radially extending from the coaxial conduits. The different effective lengths of each set of supply arms causes the spray nozzles to correspond their spraying area to the dimensions of the particular mask to be re-etched. This avoids excessive amounts of the etchant from spilling over on top of the mask. To totally preclude spilling over, baffling around the mask may be provided. Of course, both sets of spray arms 38, 32 could have the same physical length, i.e., arms 32 could extend radially for the same distance as arms 38 do, and yet arms 32 could have a shorter effective "spray length" by locating all spray nozzles of each arm 32 within a shorter radius from the center of the arms than the radius to which the nozzles on arms 38 extend.

It can be understood from the foregoing that the apparatus of the preferred embodiment could be supplied with additional coaxial conduits and additional valves so that any number of different size shadow masks can be re-etched. For instance, if desired, the preferred embodiment can be adapted for re-etching a third size shadow mask by adding another conduit, an additional control valve, and an additional set of etchant supply arms to the apparatus.

The present invention therefore provides a re-etch apparatus which is capable of re-etching a plurality of different size shadow masks. The apparatus of the present invention need not be converted to accommodate different mask sizes and makes stock piling of the masks and the storing of their corresponding image screen panels unnecessary. The present invention is also compatible with present manufacturing techniques allowing different size shadow masks to be re-etched seriatim. Since the shadow masks of each size need not be stock piled, there is little chance that a large number of tubes or panels of a particular size will be re-etched under defective conditions before the defect is detected.

While particular embodiment of the invention has been shown and described, modifications may be made, and it is intended in the appended claims to cover all such modifications as may fall within the true spirit and scope of the invention.

We claim:

1. An apparatus for re-etching the apertures of different size shadow masks to be used in color cathode-ray tubes having faceplate panel sections of corresponding different sizes, which apparatus comprises:

a source of etchant material for attacking such shadow masks;

a plurality of etchant supply means;

a corresponding plurality of sets of etchant supply arms, each arm in a set of arms having an effective spray length for spraying masks of one particular size;

means for connecting each of said supply means individually to a set of etchant supply arms; and selector means for connecting, at any given instant, only one of said supply means to said source of etchant material so that only the set of etchant supply arms whose effective spray length matches the size of the mask to be etched receives etchant.

2. An apparatus in accordance with claim 1 wherein said plurality of etchant supply means comprises a pair of coaxial conduits coupled between said plurality of sets of etchant supply arms and said source of etchant material.

3. An apparatus in accordance with claim 1 wherein said plurality of sets of etchant supply arms extend from said plurality of etchant supply means.

4. An apparatus in accordance with claim 1 which further comprises shadow mask size detecting means coupled to said selector means for determining the size of the shadow mask presented to said plurality of sets of etchant supply arms for re-etching and to provide a control signal to actuate said selector means.

5. An apparatus in accordance with claim 1 which further comprises a plurality of spray nozzles supported by said plurality of sets of etchant supply arms.

6. An apparatus in accordance with claim 5 where said spray nozzles are positioned on said plurality of sets of etchant supply arms so as to correspond the spray area of said nozzles to the dimensions of the selected one of said mask.

7. Apparatus for re-etching the apertures of cathode ray tube shadow masks of two different sizes, a first size and a second larger size, comprising:

a source of liquid etchant for etching the shadow masks;

a first set of etchant spray arms extending radially from a center conduit means and being angularly displaced from one another, the arms having a first effective spray length for spraying etchant onto masks of said first size;

a second set of etchant spray arms extending radially from the center conduit means and being angularly displaced from one another, the arms having a second effective spray length which is longer than said first effective spray length for spraying etchant onto masks of said second larger size, with the arms of said second set being interdigitated with the arms of said first set to produce an array of arms having alternating effective spray lengths;

means for conducting the etchant to the center conduit means; and means for diverting the etchant exclusively to the set of etchant spray arms whose effective spray length corresponds to the size of the mask to be etched.

8. The apparatus as set forth in claim 7 wherein the center conduit means comprises a pair of co-axial conduits each of which are connected to one of the sets of spray arms.

9. The apparatus as set forth in claim 7 which further comprises shadow mask size detecting means coupled to the etchant diverting means for determining the size of the shadow mask to be next etched and for providing a control signal for actuating the etchant diverting means.

* * * * *